United States Patent [19]

Gay et al.

[11] 4,132,169

[45] Jan. 2, 1979

[54] FUEL-AIR TYPE BOMB

[75] Inventors: Leon L. Gay; Periam B. Hardy; Donald Hutchinson, all of Boulder, Colo.

[73] Assignee: Beech Aircraft Corporation, Wichita, Kans.

[21] Appl. No.: 89,140

[22] Filed: Nov. 6, 1970

[51] Int. Cl.[2] ..... F42B 25/12

[52] U.S. Cl. ..... 102/6; 102/66; 102/90

[58] Field of Search ..... 102/6, 66, 90, 39; 149/89–91

[56] References Cited

U.S. PATENT DOCUMENTS

| | | | |
|---|---|---|---|
| 1,287,372 | 12/1918 | McGaw | 102/66 |
| 1,791,716 | 2/1931 | Davis et al. | 102/6 |
| 2,195,965 | 4/1940 | Holm | 102/39 |
| 2,372,264 | 3/1945 | Firth | 102/6 |
| 2,445,311 | 7/1948 | Cooke et al. | 102/6 X |
| 2,445,312 | 7/1948 | Cooke et al. | 102/6 |
| 2,742,856 | 4/1956 | Fieser et al. | 102/6 |
| 3,208,891 | 9/1965 | Eschrich et al. | 149/91 |
| 3,377,219 | 4/1968 | Stiefel et al. | 149/89 |
| 3,382,800 | 5/1968 | Biggs, Jr. | 102/6 |
| 3,505,957 | 4/1970 | Tichauer et al. | 102/6 |
| 3,570,401 | 3/1971 | Euker | 102/6 |
| 3,596,602 | 8/1971 | Gey | 102/90 |
| 3,596,603 | 8/1971 | Gryting | 102/6 |
| 3,730,093 | 5/1973 | Cummings | 102/6 |

*Primary Examiner*—David H. Brown
*Attorney, Agent, or Firm*—Edward L. Brown, Jr.

[57] ABSTRACT

A highly destructive fuel-air type drop bomb which requires no retardation or restriction of its terminal velocity for efficient detonation; which utilizes a normally non-explosive, normally liquid fuel dispersed in air for its explosive power; which centrally carries a low brisance heaving type fuel dispersing explosive surrounded by the body of liquid fuel; which includes a proximity fuse to detonate the low brisance explosive to break the fuel container and to disperse the fuel into the surrounding air in minute particles to form an aerosol cloud of large volume and of substantially uniform density in close proximity to the target; and which carries a time delay detonator for detonating the aerosol cloud after it has formed.

9 Claims, 3 Drawing Figures

LEON L. GAY
PERIAM B. HARDY
DONALD HUTCHINSON
INVENTORS

BY Miller & Brown
ATTORNEY

FUEL-AIR TYPE BOMB

This application is a continuation - in part of application Ser. No. 823,235, filed Apr. 28, 1969 entitled Fuel-Air Type Bomb.

This invention relates to aerially delivered destructive bombs in general, and more particularly to a bomb which will herein be referred to as a fuel-air mixture type bomb, as opposed to a bomb the explosive power of which is provided by a concentrated highly explosive material. The high explosive bomb has a destructive effect over only a very limited target surface area, whereas the fuel-air bomb has a destructive effect over a much greater surface area.

Certain Government Agencies and their contractors have recently produced and tested fuel-air mixture type bombs, all of which have had critical disadvantages. The bombs tested have carried either pressurized propane or ethylene oxide as fuel to provide the ultimate explosive effect, when mixed with air. The fuel has been dispersed into the air by means of a high brisance explosive. Fuel dispersal by means of a high explosive has resulted in the formation of a doughnut shaped cloud of fuel-air mixture which cannot be efficiently detonated by detonators located in its void central area.

For this reason such bombs necessarily have had to carry numerous cloud detonators, together with a means for distributing these detonators into various locations within the surrounding doughnut shaped cloud prior to actuating the detonators. Since the downward velocity of travel of the bomb hardware, after fuel dispersal, is much greater than that of the doughnut shaped cloud, it has not been possible to properly distribute the detonators into the doughnut shaped fuel-air mixture without retarding the terminal velocity of the bomb.

Low terminal velocity for such bombs has been achieved by release of one or more bomb carried parachutes for the bomb at a predetermined time interval after bomb release from the carrier.

Retardation of bomb terminal velocity by parachutes constitutes another disadvantage of bombs of the fuel-air type previously tested.

Such parachute lowered bombs are subject to wind drift, enemy detection and dispersal prior to bomb detonation, hanging up in trees, etc. Furthermore, the detonation of a torus shaped cloud formed by liquid fuel dispersion in air does not produce either the desired intensity of explosive overpressure adjacent the target, or distribution of the overpressure over a sufficiently large area.

Generally, a bomb embodying my invention includes a housing having walls which define two separate sealed, concentrically arranged chambers. The smaller central burster chamber contains a low brisance heaving type explosive; the second and larger chamber which surrounds the central chamber, carries a liquid fuel. While it was previously felt in some quarters that a third chamber, which surrounds the fuel chamber, containing an inert material having a high vapor pressure was necessary to retard or prevent pre-burn of the fuel; it is now known that a third chamber is not necessary.

At its forward end the bomb housing carries a sequence initiating proximity fuse of any desired type, connected by prima cord or electrical detonator extending well into the low brisance explosive in the central chamber.

Immediately adjacent the aft ends of the two chambers, the housing carries a fuel cloud detonating assembly which includes a time delay mechanism connected by prima cord or electrical detonator extending well into the low brisance explosive in the central burster chamber.

When the bomb closely approaches the target the proximity fuse is activated, the low brisance explosive is detonated, creating an internal pressure which ruptures the walls of all the chambers in the housing. The fuel is dispersed in minute particles into the surrounding air by the expending pressure created by the explosion of the central burster charge. The fuel creates an expanding aerosol cloud of substantially uniform fuel-air density.

Shock waves from the explosion of the low brisance central burster charge activate the time delay cloud detonator mechanism and the entire fuel-air cloud is detonated at a predetermined time after proximity fuse activation, for instance, 100 to 125 milliseconds, which affords ample time for the formation of an aerosol fuel air cloud of large volume extending over a large surface area.

Due to the fact that the low brisance explosive, such as 30% to 50% gelatin dynamite, creates a heaving outward pressure rather than an extreme shock, the aerosol type fuel-air cloud which is formed by my bomb is of substantially uniform density throughout its volume, as opposed to the doughnut shaped clouds formed by a high brisance explosive. Other types of low brisance explosives which produce an effect having similar characteristics include the conventional explosives of Astrolite and Nitroguanidine. Due to its uniform density, the high explosive fuel-air cloud formed by my bomb can be detonated at any location within the cloud boundary. Consequently in my bomb there is no necessity for discharging a plurality of cloud detonators into the cloud from the falling, ruptured bomb housing, and the necessity for retarding the terminal velocity of the bomb by parachute or other means is also eliminated. The cloud detonator assembly in my bomb is fixed to the bomb housing and remains with the ruptured housing as it falls through the aerosol cloud.

An additional advantage is the use of a fuel which is non-gaseous at standard temperature and pressure, thus eliminating the necessity of providing a pressurized fuel chamber. The use of non-gaseous fuels, such as Normal Propal Nitrate ($C_3H_7NO_3$), Ethyl Propal Nitrate ($C_2H_5NO_3$); and mixtures of both 58% to 60% ($C_2H_5NO_3$) and from 40% to 42% ($C_3H_7NO_3$); have been successfully used.

My invention will be more clearly understood when the following description is read in connection with the accompanying drawings, in which.

Figure 1:
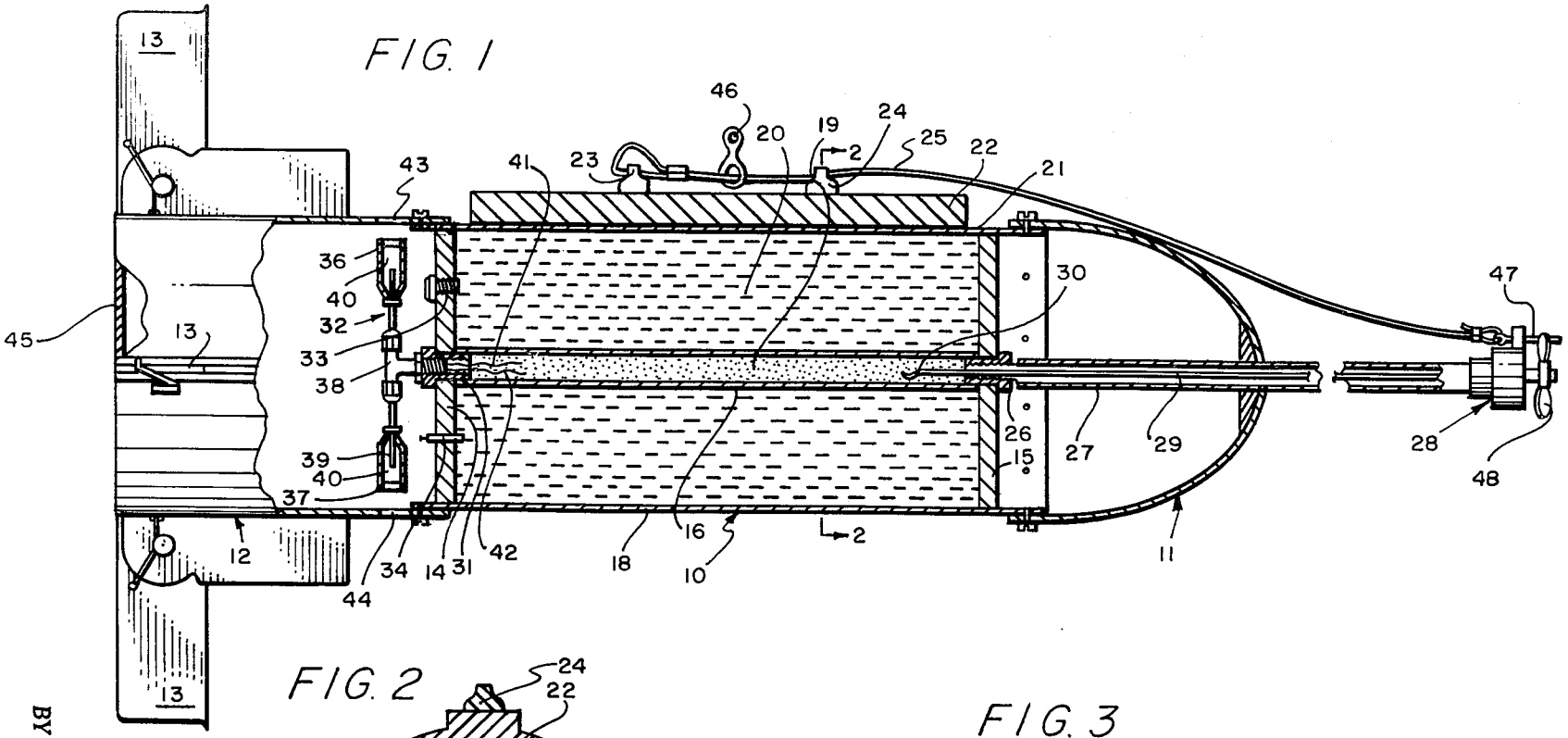
FIG. 1 is a central longitudinal sectional view through a bomb embodying my invention.

Referring to FIG. 1 of the drawings, the illustrated preferred embodiment of my invention includes a load carrying housing designated as a whole by the numeral 10; a combination nose cone and fuse supporting member, designated as a whole by the numeral 11, suitably secured to the forward end of housing 10; and a tail assembly rigidly secured to the aft end of housing 10 and designated as a whole by the numeral 12, and pivotally supporting a plurality of outwardly spring pressed, retractable stabilizing fins 13.

Housing 10 includes rigid circular end plates 14 and 15. Concentric cylindrical walls 16 and 18 have their opposite ends secured to the respective end-plates in sealed, leak tight relationship, as by welding or other means. The two walls thus define two separate, concentric sealed chambers 19 and 20. The innerwall 16 can be constructed of materials other than aluminum such as plastic, stainless steel, and brass. When utilizing certain burster explosives that can be placed directly in the fuel, the innerwall 16 can be eliminated.

An elongated rigid stiffener and swaybrace 22 is secured longitudinally to the exterior surface of outer housing wall 18, as shown. On its outer surface stiffener 22 carries carrying lugs (not shown) and fixed fore and aft aligned eyelets 23 and 24 which serve as guides for a fuse arming lanyard 25.

Forward end plate 15 centrally carries a rigidly fixed, internally threaded fitting 26, which receives and supports the inner end of a tubular fuse support 27. Support 27 extends centrally through and well beyond the forward end of nose cone 11 and a suitable proximity fuse 28 is fixed on the forward outer end of the support.

The fuse illustrated is a standard stab detonator type, identified by the Department of Defense (Army) as an M158 fuse. Its operation will be subsequently described. The fuse illustrated can be classed as a proximity fuse because it is positioned ahead of the nose of the bomb, and it is detonated by impact before the bomb housing actually contacts the target. By varying the length of fuse support 27, the fuse detonation time prior to fuel cloud detonation can be varied.

Furthermore, that portion of fuse support 27 which extends beyond the forward end of nose cone 11 may be eliminated and an entirely different type of proximity fuse secured to the nose cone. Other suitable fuses are the Radar Proximity Fuse Mark 43 TDD, the Infra-Red Air Proximity Fuse, or the omni-directional, stab pin-percussion cap, explosive train fuse FMU 68, all of which are in common use by the Department of Defense, and are of well known construction.

Regardless of the type of fuse used, the explosive element of the fuse is connected to a length of prima cord 29, which extends through fuse support 27, through fitting 26, and well into a body of low brisance dynamite gel, with which chamber 19 is packed. The inner end of the prima cord fuse train is designated by numeral 30.

Referring now to the aft end of the bomb, rear end plate 14 centrally carries a fixed internally threaded tubular fitting 31, which receives and supports a cloud detonator assembly in a position immediately adjacent the rear end plate 14, the cloud detonator assembly being designated as a whole by the numeral 32.

Aft end plate 14 is provided with a filler hole for chamber 20, which is sealed by a plug 33 after chamber 20 has been filled, preferably with a fuel of the class which is not gaseous and staple at normal temperatures and pressures but when dispersed in the air forms a highly explosive mixture.

Chamber 20 is also provided with a short vent tube 34, which extends through end plate 14, and the outer end of which is crimped and sealed after the chamber has been filled.

CLOUD DETONATOR ASSEMBLY

Figure 3:
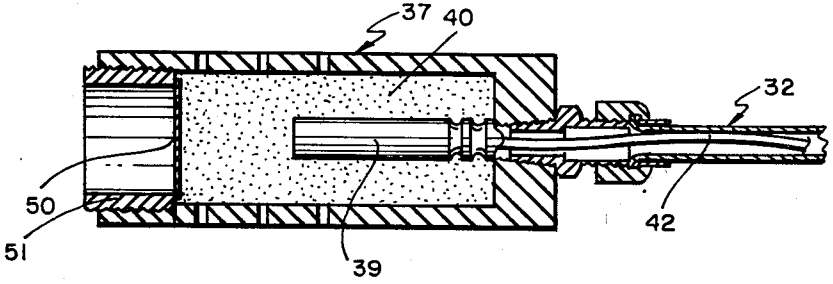
FIG. 3 is an enlarged longitudinal sectional view through one explosive output tube of the cloud detonator assembly.
Figure 2:
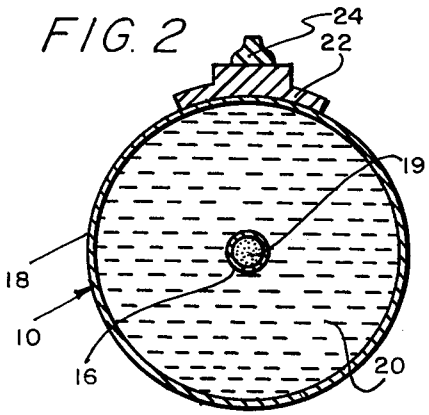
FIG. 2 is a transverse sectional view of the same, taken along the plane indicated by the line 2—2 in FIG. 1.

This assembly 32, shown in detail in FIG. 3, consists of two perforated high explosive output tubes 36 and 37, the outer ends of which are closed by a thin membrane 50 fixed to the inner end of a threaded plug 51. The two output tubes 36 and 37 are mounted in aligned, opposed relationship, for redundancy. They are respectively supported on the opposite outer ends of a dense metal "T" fitting 38 (FIG. 1), which in turn is threaded into and supported by the fitting 31 in aft end plate 14.

As shown in FIG. 3, the inner end of each output tube internally supports a standard pyrotechnic time delay detonator 39 having a predetermined time delay of around 100 milliseconds. Each detonator 39 is embedded in a body 40 of high explosive, such as TNT, RDX, or PETN, carried by each output tube.

The time delay detonator 39 in each output tube is connected to a length of prima cord, and each cord extends through "T" fitting 38 well into the low brisance explosive in chamber 19. The inner ends of the two cords are designated by the numerals 41 and 42.

When the described cloud detonator assembly 32 and the tail assembly 12 are in assembled relationship, as shown in FIG. 1, the respective outer ends of the detonator output tubes 36 and 37 are positioned adjacent and in alignment with respective apertures 43 and 44 in the cylindrical wall of the tail assembly. As a safety measure these apertures remain plugged by suitable plugs (not shown) until the bomb is readied for drop. The aft end of the cylindrical wall of assembly 12 is preferably closed by a flat plate 45 so that assembly 12 provides a protective housing for cloud detonator assembly 32.

OPERATION

When the described bomb is mounted in a bomb rack, eyelet 46, through which arming Lanyard 25 is threaded, is connected to the rack.

When the bomb rack is actuated to jettison the bomb, secured eyelet 46 pulls aft on lanyard 25, which is connected to slide pin 47 of fuse 28, and pulls pin 47, out of its propeller blocking position. Free fall of the bomb causes air driven propeller 48 of fuse 28 to spin. A predetermined number of propeller revolutions retracts a detonator holding screw within the fuse 28 and retraction of the screw permits a stab pin detonator to be spring rotated into alignment with an impact firing pin in the fuse. This completes safe arming of the fuse firing circuit after the bomb has left the carrier. Details in the construction of fuse 28 are not shown and are not considered necessary because they are well known to those familiar with this art, and the specifications for the M158 fuse are fully disclosed in Army Manual TO 11A-1-31 OP1664 (Vol.2) -PP471-473. Furthermore, almost any type of military qualified proximity fuse can be used with this bomb, as previously explained.

As the bomb during its free fall approaches the target, fuse 28 makes target impact before housing 10 reaches the target proper. Impact of the fuse 28 forces the fuse firing pin into the stab detonator within the fuse. The detonator fires and sends an explosive shock wave along the prima cord 29 into the low brisance gelatin dynamite in chamber 19 and detonates that explosive.

The heaving explosion energy is transmitted to the liquid normal-propyl nitrate in chamber 20. The hydrostatic pressure generated by the central burster explosion ruptures and shatters the walls of both chambers 19 and 20 and ejects and disperses liquid fuel particles into the surrounding air, forming a rapidly expanding, free standing aerosol cloud. The fuel-air mixture of the cloud formed is of substantially uniform density and the fuel-oxygen mixture in the cloud is highly explosive.

Detonation of the gelatin dynamite central burster charge 19 propogates shock waves which are transmitted by prima cords 41 and 42 to the detonators 39 in the respective high explosive output tubes 36 and 37. After the pre-determined time delay, as for instance 100 milliseconds, detonators 39 detonate the high explosive charges 40 in tubes 36 and 37, before the aft end plate 14 and its connected cloud detonator assembly 32 have had time to travel through and outside the aerosol cloud. Explosion of the TNT or other high explosive charges 40 detonates the entire previously formed aerosol cloud.

Tests show that detonation of the aerosol cloud generates a shock wave which produces an overpressure of 300 psi radially outward 10 feet from hardware impact point, 200 psi radially outward 20 feet, and 100 psi radially outward 30 feet.

Tests show that aerosol cloud detonation also generates an extremely high overpressure in a downward direction. Calibrated crush indicators, rupture discs, gauges, piezo-electric shock transducers, and other diagnostic equipment set in deep fox holes, covered bunker arrays, etc., have shown terminal effects equal to or greater than target damage at ground level and above. This extreme downwardly directed over pressure can only be explained by theory.

In summary the above described invention provides a bomb which is so constructed that it utilizes a relatively safe, normally non-explosive, normally liquid, unpressurized rocket fuel to produce a highly destructive terminal effect on targets; a bomb which forms a highly explosive aerosol type fuel-air cloud of substantially uniform fuel-air density which can be detonated at any location within its boundary; and which, because of the last above specified feature, can be effectively used without any slowing of the terminal velocity of the bomb.

Having described the invention with sufficient clarity to enable those familiar with this art to construct and use it, I claim:

1. A fuel-air type explosive bomb comprising, a housing;

a nitrated organic liquid fuel selected from the group consisting of ethyl nitrate, normal propyl nitrate, and a mixture of ethyl nitrate and normal propyl nitrate, within the housing;

a confined body of low brisance heaving type explosive having a detonation velocity of less than 3,000 feet per second, located within the housing and said liquid fuel which when exploded ruptures the housing and disperses the fuel in an aerosol cloud;

a proximity fuse means supported by the housing, and connected to the low brisance explosive by a shock wave transmission means; and a fuel-air cloud detonating means carried on the housing, including:

(a) a confined small quantity of high explosive and (b) a milliseconds time delay detonator associated with said high explosive for detonating the high explosive a predetermined number of milliseconds after the low brisance explosive has exploded and shock wave transmitting means connecting the interior of the body of the low brisance explosive with said time delay detonation.

2. A bomb as described in claim 1, wherein the normally non-explosive liquid fuel is normal propyl nitrate.

3. A bomb as described in claim 1, wherein the normally non-explosive liquid fuel is ethyl propyl nitrate.

4. A bomb described in claim 1, wherein the normally non-explosive liquid fuel is a mixture of: from 58% to 60% $C_2H_5NO_3$ and from 40% to 42% $C_3H_7NO_3$.

5. A bomb as described in claim 1, wherein the normally non-explosive liquid fuel is a mixture of $C_2H_5NO_3$ and $C_3H_7NO_3$.

6. A bomb as described in claim 1, wherein the low brisance explosive in the first chamber is nitroguanidine.

7. The bomb described in claim 1, and:

a tail assembly supported by the aft end of the housing and including;

(a) a protective enclosure for the cloud detonating assembly, and (b) aerodynamic fins supported by the enclosure for stabilizing the free fall of the bomb through the air.

8. The bomb described in claim 1 in which:

the low brisance explosive in the first chamber of the housing is gelatin dynamite; and the normally non-explosive flammable fuel in said second chamber is normal-propyl nitrate.

9. The bomb described in claim 1 in which the proximity fuse includes a time delay fuse arming mechanism and;

a lanyard connected to said fuse arming mechanism and to the exterior of said housing; and means for connecting an intermediate portion of the lanyard to a fixed portion of an airplane or other bomb carrier, so that when the bomb is released from the carrier the lanyard initiates action of the time delay fuse arming mechanism of the fuse.

* * * * *